United States Patent [19]

Faure

[11] 4,296,598

[45] Oct. 27, 1981

[54] APPARATUS FOR PROVIDING FALSE TWIST TO MOVING YARN

[76] Inventor: Jean-Louis Faure, 21, rue des Lilas, Mably - 42300 Roanne, France

[21] Appl. No.: 150,642

[22] Filed: May 16, 1980

[30] Foreign Application Priority Data

May 22, 1979 [FR] France ..... 79 13915

[51] Int. Cl.[3] ..... D02G 1/06; D01H 7/92

[52] U.S. Cl. ..... 57/284; 57/336

[58] Field of Search ..... 57/284, 332, 334, 336

[56] References Cited

U.S. PATENT DOCUMENTS

| | | | |
|---|---|---|---|
| 3,228,181 | 1/1966 | Paterson | 57/336 X |
| 3,659,408 | 5/1972 | Burr | 57/336 X |
| 4,047,373 | 9/1977 | Takai | 57/336 |
| 4,144,700 | 3/1979 | Takai et al. | 57/336 X |
| 4,144,701 | 3/1979 | Takai et al. | 57/336 |
| 4,218,870 | 8/1980 | King | 57/284 |
| 4,248,038 | 2/1981 | Takai | 57/336 |

*Primary Examiner*—Donald Watkins

*Attorney, Agent, or Firm*—Frank S. Vaden, III

[57] ABSTRACT

Apparatus including two endless aprons, one operating inside the other, the top strands thereof forming a contact zone therebetween. The aprons are angled with respect to each other preferably between 130 and 150 degrees. The yarn applied through the zone is twisted upstream of the zone with respect to a variably adjustable, insertion length stop. The yarn can be heat treated, if desired, upstream or downstream of the contact zone. Alternatively, two or more yarn strands also can be false-twisted in parallel paths through the zone and joined thereafter. By changing the length of insertion of one strand with respect to the other, alternated twist is provided to the combined yarn.

10 Claims, 4 Drawing Figures

FIG. 4
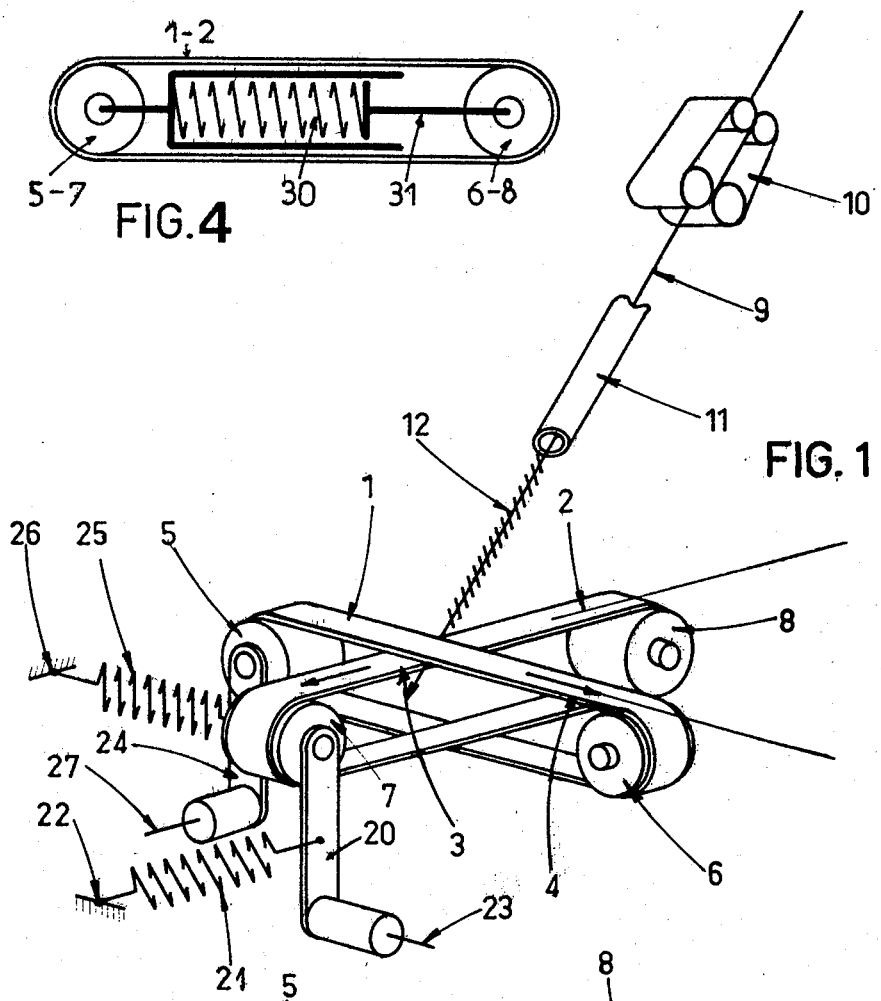
FIG. 1
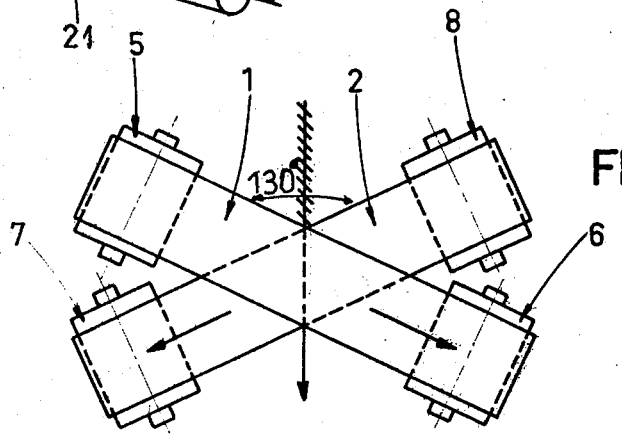
FIG. 2

APPARATUS FOR PROVIDING FALSE TWIST TO MOVING YARN

BACKGROUND OF THE INVENTION

1. Field of the Invention

This invention relates to yarn handling apparatus and more specifically to apparatus suitable for transmitting by friction a false-twist to the yarn progressing therethrough, which procedure is useful in many texturing and other applications.

2. Description of the Prior Art

The technique of applying a false twist by friction to a moving yarn has been known for a long time. The technique comprises, broadly speaking, setting the moving yarn in contact with a moving surface, displacing it transversely with respect to the path of the yarn so that the yarn is twisted upstream of where the yarn is manipulated and permitting the yarn to regain its original twist downstream thereof.

This technique, for which many applications have been foreseen, has mainly been utilized for texturing synthetic yarns. That is, by applying false-twist to such yarns while also applying a thermal heating and cooling upstream of the false-twist element, such yarn is provided with volume and elasticity.

However, other applications of using false-twist have been proposed. For example the literature suggests false twisting in the context of producing fancy yarns, yarns having alternate twists along their lengths, autotwisted yarns, and the like.

Thus, it has been proposed in U.S. Pat. No. 3,415,048 to obtain alternate twist yarns, that is, to produce yarn having successive zones with "S" and "Z" twist along the yarn length, by utilizing a false-twist spindle and by changing the twist insertion length upstream of the spindle, according to a selected frequency.

Several embodiments for providing false twist have been proposed which provide a moving surface for communicating a twist by friction to a yarn. Those presently used in the texturizing field either employ bushings against which the yarns is urged into contact (internal friction false twisting) or overlapping discs mounted on parallel axles, the moving yarn contacting the outer surface of these discs (external friction false twisting).

It has also been proposed in French Pat. Nos. 1,191,361 and 1,255,922 and in U.S. Pat. No. 2,908,133 to utilize as a means for inserting the false twist, one or several endless belts or aprons against which the yarn rubs.

As illustrated in French Pat. No. 1,147,515 (U.S. Pat. No. 2,943,433) it has been proposed to thread the yarn between two moving aprons, these aprons being arranged diagonally with respect to each other in such a way that an impulsion is conferred in the direction of their displacement during the passage of the yarn between the aprons.

However, as set forth therein, the device must operate at relatively low speed in that it is necessary, where the aprons cross, to guide them exactly according to parallel planes and to keep the aprons at a distance from one another slightly smaller than the yarn thickness for which it is desired to provide the false twist. This implies a complex apron guidance system.

Further, the aforementioned patent presents an alternate embodiment wherein the aprons are replaced by two hyperboloids which are driven in rotation, the crossing angles between the axis thereof being at an angle of between 30 and 45 degrees, the yarn passing between them along a straight line crossing both of the hyperboloid axes at equal angles.

Although the embodiment described therein appears somewhat attractive, it has the disadvantage of utilizing parts having a complicated shape, making it difficult also to feed and otherwise adjust. And, as in the case of the apron device therein described, the device is rather cumbersome owing to the fact that the two parts in between which the yarn passes are arranged one on top of the other.

Furthermore, although the contact surface of the two hyperboloids is a straight line, it is practically impossible to maintain the yarn according to such straight line, which therefore leads to a variable action of the hyperboloids on the yarn.

Finally, with regard to the superimposed crossed apron device described in that patent, it has been noticed that in normal operation, they tend to displace themselves laterally on their guide roller, which displacement, of course, disturbs their intended functioning.

Therefore, it is an object of the present invention to provide an improved and perfected device permitting the communication of false-twist by friction to a moving yarn by means of endless aprons, which have the actual advantages of the formerly proposed apron device shown in U.S. Pat. No. 2,943,433, but without the disadvantages thereof particularly owing to the fact that the invention incorporates a scheme for reducing the volume of the apparatus of the prior art device and assures a mutual contact between both aprons in a much more precise manner than theretofore achieved.

SUMMARY OF THE INVENTION

Generally speaking, the invention concerns apparatus for communicating a false-twist by friction to a moving yarn, comprising two endless aprons or belts, inclined one to the other, having two strands in mutual contact, the yarn passing between these aprons in the zone where they are in contact. In addition to providing false twist by the action occurring in the contact zone, the apparatus according to the invention permits the yarn to pass therethrough and also to permit treatment, if desired, simultaneously with the false twisting, either upstream of such action or downstream or both.

The apparatus permits, for example, appropriate associated components of equipment to wind up the processed yarn after it has been completely processed without requiring an additional step or interfering with the false twist step.

As mentioned above, associated equipment conventionally useful in treating yarn also can be employed with the apparatus herein described. Such equipment includes heater means for thermally heating the yarn either upstream or downstream of the false twist apparatus. Such a process is employed, for example, in texturing yarn.

Moreover, the apparatus for false twisting the yarn also operates in conjunction with associated equipment for varying the speed of yarn being fed through the apparatus and/or for varying the twist insertion length upstream of the false twist apparatus when it is desired, for example, to obtain a yarn presenting an alternated twist along its length.

The apparatus is useful, it should be noted, for treating filament yarn, for spun fiber yarn, or even for single rovings.

The apparatus is characterized in its preferred embodiment by having each of the aprons fitted on a pair of rollers whose diameters and positioning causes one of the aprons to operate inside of the other.

A simplified and preferred embodiment of the apparatus provides for identical guide-and-drive-roller-dimensioning for the two aprons, which provides that both the top and bottom strands of the two endless aprons to be in mutual contact. In addition, the guide rollers can be adjusted to vary the contact pressure between the aprons in the contact zone and hence consequently modify the twist given by the pressure. This can be provided by adjusting the tension of aprons and/or by slightly relocating the axis of the rollers.

Means are also provided for axially orienting the rollers with respect to each other in order to correctly center each apron.

Furthermore, to provide for precision adjustment of the contact zone, the basically cylindrical guide rollers can also be cambered by suitable and conventional means. The guide rollers are preferably arranged with their axis in the same plane, but it is permissible to modify them with respect to each other so that the apron strands in the contact zone are in suitable mutual contact.

Furthermore, the preferred embodiments of the invention contemplate that the yarn or strands of yarn be introduced in the same plane as the plane of the contact zone; however, the introduction of yarn alternatively can be introduced at a different angle. Moreover, the entry angle and the exit angle from the contact zone can be different from each other.

The apparatus described herein is shown in one of its preferred embodiments in a configuration suitable for obtaining autotwisted yarns. In such a configuration, at least two strands of yarn are guided across the contact zone in parallel fashion, each being friction twisted. A guide located downstream of the contact zone permits the joining of the processed yarn.

When the apparatus is employed in this latter application, means are associated with the aprons so that one of the yarn strands is provided with an alternate twist over its length, such means being, for example, of the type described in U.S. Pat. No. 3,415,048. One such means, for example, is a variable insertion length stop device which provides for varying the insertion length undergoing twist upstream of the contact zone.

The two aprons of the present invention form an angle related to the twist that is desired to be communicated into the yarn. Advantageously, this angle, which is conveniently defined by the angle between the displacement direction of the aprons or belts, is in excess of 90 degrees when viewed from the insertion direction of the arriving yarn. It has been determined that an angle in the neighborhood of 130 degrees is perfectly suitable when it is desired to use the apparatus for alternate twist yarns joined downstream of the aprons by autotwist. On the other hand, an angle in the neighborhood of 150 degrees is more particularly suited for communicating false twist to a single yarn.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiments thereof which are illustrated in the appended drawings, which drawings for a part of this specification. It is to be noted, however, that the appended drawings illustrate only preferred embodiments of the invention and are therefore not to be considered limiting of its scope, for the invention may admit to other equally effective embodiments.

IN THE DRAWINGS

Figure 3:
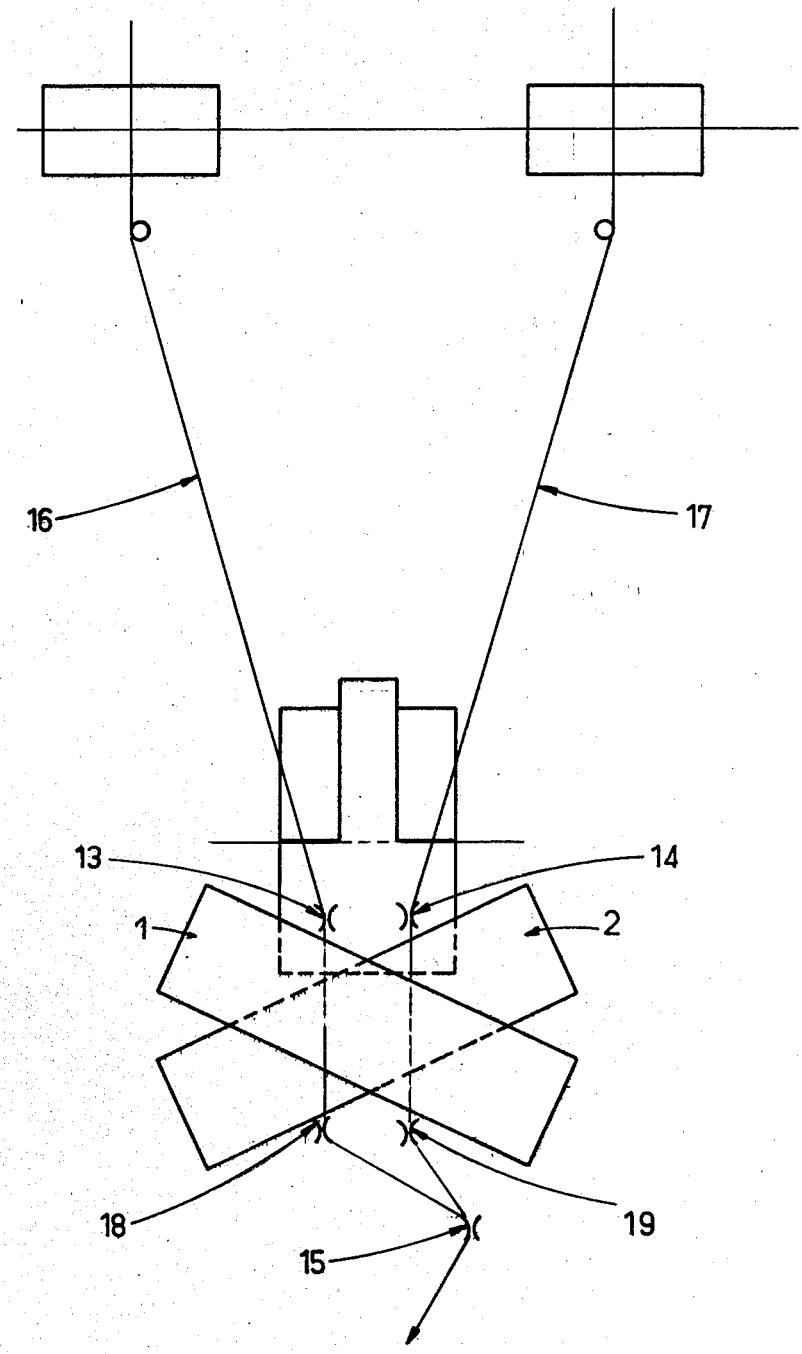

FIG. 1 is a schematic representative in perspective, of apparatus in accordance with a first embodiment of the present invention in an application useful for texturing a yarn by false-twist.

FIG. 2 is a top plan view of apparatus according to the schematic view shown in FIG. 1.

FIG. 3 is a schematic representation, top view, of apparatus in accordance with a second embodiment of the present invention in an application useful for producing auto-twisted yarns.

FIG. 4 is a schematic side view of an alternate apron in accordance with the present invention fitting on its two guide rollers and including means for tensioning the apron.

DESCRIPTION OF THE PREFERRED EMBODIMENTS

Now referring to the drawings and first to FIG. 1, apparatus according to the present invention primarily comprises two endless aprons 1 and 2, whose respective upper elongate strands 3 and 4 are in mutual and parallel contact to form a contact zone therebetween. It is through the zone that the yarn is twisted in the inventive method hereinafter described. Furthermore, elongate strands 3 and 4 are positioned at an angle with one another, which is best illustrated in FIG. 2. In a preferred arrangement the angle between the aprons is established to be at 130 degrees, as illustrated.

Endless aprons 1 and 2 are respectively fitted on a set of drive and guide rollers, namely, rollers 5 and 6 for apron 1 and rollers 7 and 8 for apron 2. Further, apron 2 is positioned in such a way that it passes through or inside the center opening of apron 1. In a preferred embodiment rollers 7 and 8 are of substantially the same outer diameter as rollers 5 and 6. Hence, aprons 1 and 2 contact one another not only at their upper strands but at their lower strands, as well. Drive and guide rollers 5, 6, 7 and 8 are driven in rotation by means not illustrated and are typically arranged in a conventional manner on a supporting mount integral with a frame.

In the embodiment illustrated in FIG. 1, tension is applied to both aprons 1 and 2 by submitting one of the pair of the respective rollers guiding and driving the aprons to the outward resilient action of springs. Apron 1 is tensioned by spring 25 connected to roller 5 and apron 2 is tensioned by spring 21 connected to roller 7. Spring 25 achieves its function by being attached between a fixed point 26 and arm 24 fitted to roller 5 at one end thereof at its extremity by articulated axle 27. Tension is varied on apron 1 by the positioning of axle 27. In like manner, spring 21 achieves its function of tensioning apron 2 by being attached between a fixed point 22 and arm 20 fitted to roller 7 at one end thereof and at its extremity by articulated axle 23. Tension is varied on apron 2 by the positioning of axle 23.

The axles are adaptable for fitting with other components not shown to enable their respective positioning to be in a parallel relationship with the axis of the guide roller attached to the opposite end of the respective articulate arms. This parallel relationship maintains the correct positioning of the aprons or belts regardless of the tension setting.

Furthermore, the arrangement allows for varying lateral pressure of the apron contact apart from its effect on such pressure through stretching.

In a variation of the tensioning scheme, it can be observed in FIG. 4 that rollers 5 and 6 (and rollers 7 and 8) are alternately tensioned by an intermediate spring 30 under compression and operating to push outwardly against cooperating sliding parts 31. One of the sliding parts is attached to each of the respective rollers and they operate in a cooperating cylindrical relationship with each other to exert the pressure on the rollers. Of course, FIG. 4 illustrates a scheme for tensioning adjustments on the aprons. When this scheme is employed, and when one apron is positioned inside the other, the tensioning parts just described will have to physically accommodate to the presence of one apron encompassing the other.

Regardless of which scheme of tensioning is employed, it is possible by changing the tension on the aprons to ajust the amount of twist which is desired on the yarn in the contact zone.

Now returning to FIG. 1, yarn 9 originating from a supply not shown is delivered by a delivery device 10 in the form of cooperating endless belts or any other appropriate means and directed through the contact zone between strands 3 and 4 of the aprons. On the exit or downstream side of the contact zone, the yarn is wound up or submitted to a desirable conventional process which is compatible with the false-twist method of the present invention.

In the illustration, yarn 9 is subjected to texturing upstream of the contact zone. Delivery device 10, which can be two contiguously pressed-together belts operating around respective rollers, operates as a twist insertion locking component. That is, the twisting of the yarn is with respect to output side of device 10. Thermal treatment heater 11 between device 10 and the contact zone provides the heat treatment necessary for texturing the yarn. This heater is followed by a cooling zone 12, which may be a non-heated area or an area where the yarn is subjected to chilling below ambient temperature. Hence, it can be seen that the twist exerted on the yarn in the contact zone causes the twist to be backed up through the heater and the cooling zone. The yarn regains its original non-twist condition as it exits the contact zone.

As illustrated in FIG. 3, the apparatus just described can also be used for communicating an alternated twist to two strands of yarn 16 and 17, both of which are in motion from separate sources (not shown). On the downstream side of the contact zone, the two yarn strands are joined by autotwist.

The strands may approach the upstream side of the contact zone in a non-parallel manner. However, upstream and downstream of the aprons yarn strand 16 progresses through guides 13 and 18, respectively, and yarn strand 17 progresses through guides 14 and 19, respectively. These guides ensure that yarn strands 16 and 17 progress through the contact zone in parallel fashion. Downstream of guides 18 and 19, and preferably to one side, guide 15 provides the joining of the two yarn strands, the single autotwisted yarn being drawn therefrom as a single yarn.

In an actual application of the mode illustrated in FIG. 3, altering the twist transmitted to a strand of the yarn can be provided by changing the yarn strand delivery speed, or, preferably, by changing the twist insertion length of the strand of yarn upstream of the contact zone of the false twist device.

EXAMPLE 1

Apparatus consistent with the invention can preferably be utilized incorporating two endless aprons 1 and 2, each having a length of 28 centimeters and fitted on rollers 5, 6, 7 and 8 each having a diameter of 2.5 centimeters. The width of the aprons is 1.5 centimeters.

The aprons are each driven at a speed of 550 meters per minute, the two strands of aprons or belt 1 respectively being in contact with the respective two strands of apron 2. The angle formed between the two belts is 150 degrees.

The preferred embodiment just described is suitable for handling polyester yarn of 72 decitex, 34 filaments, at a delivery speed of 400 meters per minute.

The twist transmitted to the yarn upstream and which backs up to delivery device 10 is preferably adjusted to be on the order of 2400 turns per meter.

When the apparatus is utilized in this way, a textured yarn is obtained which has characteristics comparable to yarns textured by means of internal friction spindles. In fact, the yarn produced hereinabove can be considered to be better than such prior art produced yarn by the fact that not only do the aprons communicate a twist to the yarn but they also provide uniformity of progression.

EXAMPLE 2

The same false-twist device as shown in FIG. 1, but arranged for treating two yarn strands as shown in FIG. 3, can perferably be utilized for such yarn in the manner below. Guides 13 and 14 are positioned downstream to allow parallel spaced-apart yarns strands 16 and 17 to be at a distance from each other which is set at 10 millimeters.

Guide 15 is positioned at a distance which is 5 centimeters on the downstream side of the contact zone and the twist insertion lock or stop device for the yarn strands is located at a distance of 27 centimeters upstream of the contact zone. The progression of the yarn strand is adjusted so that it progresses through the distances just described in 0.65 seconds.

In this way, two yarn strands 16 and 17 can be delivered, each one having a core formed by a 167 decitex, 33 filament false-twist textured polyester yarn covered by 20 micron wool, the total count of each elementary yarn being of 250 decitex.

With the spacing described above, the two yarn strands are delivered at a speed of 205 meters per minute. The two aprons are run at the same speed as in Example 1.

At the exit means for the Example 2 arrangement, that is, at guide 15, an assembly yarn is obtained by autotwist of yarn strands 16 and 17, this assembly yarn presenting along its length alternate twisted zones of about 50 turns in the "Z" direction and 50 turns in the "S" direction.

The preceding examples illustrate the advantages provided by the invention and more particularly the great flexibility of the apparatus.

Furthermore, it has been observed that during a long run, with respect to apron devices in which both aprons were superimposed with respect to one another, very good lateral stability of the aprons was achieved, which also resulted in a greater regularity of the produced yarn.

Of course, the apparatus described above presents only representative preferred embodiments of the invention. Various modifications and variations to the specific embodiments will be apparent to those having ordinary skill in the art without departing from the spirit and scope of the invention. For example, the illustrations given above describe aprons having a rectangual cross-section. However, it is apparent that aprons having other cross-sectional forms can be utilized. For example, aprons having a circular cross-section can be employed, as well as aprons incorporating a plurality of elementary aprons placed side by side. Also, the yarn does not have to be fed in a plane with the contact zone, but can be fed at an angle therewith. Moreover, the exit direction of the yarn from the contact zone may be at a different angle of the yarn into the contact zone, if desired.

What is claimed is:

1. Apparatus for providing a false-twist by friction to a moving yarn, comprising a first endless apron, a second endless apron positioned at an angle with respect to said first apron, at least one strand of said second apron being in contact with a strand of said first apron, the moving yarn being directed to pass between said first strand and said second strand in the zone of contact to a downstream location, a first set of rollers fitting said first apron, and a second set of rollers of external diameter fitting said second apron to permit said second apron to pass inside said first apron, whereby relative movement of said contacted strands of said first and second aprons impart false-twist to the yarn in the contact zone.

2. Apparatus in accordance with claim 1, and including take-up means downstream of the contact zone.

3. Apparatus in accordance with claim 1 or claim 2, and including yarn thermal treatment means applied to the moving yarn while it is undergoing false-twisting.

4. Apparatus in accordance with claim 1 or claim 2, and including means upstream of the contact zone for varying the twist insertion length of the yarn, thereby altering the resulting false-twist length thereof.

5. Apparatus in accordance with claim 1, wherein said first set of rollers and said second set of rollers are substantially indentical so that both strands of both aprons are in respective contact.

6. Apparatus in accordance with claim 1, and including upstream means for guiding the yarn into the contact zone in the plane of said aprons in said zone.

7. Apparatus in accordance with claim 1, and including upstream means for guiding the yarn into the contact zone of said aprons at a first angle and downstream means for guiding the yarn from the contact zone of said aprons at a second angle.

8. Apparatus in accordance with claim 1, and including a first guide for a first moving strand of the yarn and a second guide for a second moving strand of the yarn for parallel guiding the first and second yarn strands through the contact zone, and a third guide downstream of said contact zone for assembling by autotwist said false-twisted first and second yarn strands.

9. Apparatus in accordance with claim 1, wherein the angle said second apron is with respect to said first apron is in the approximate range between 130 and 150 degrees.

10. Apparatus in accordance with claim 1, and including tension means connected to provide tensioning to at least one of said first set of rollers and said second set of rollers.

* * * * *